US008757179B2

(12) United States Patent
Wetzel et al.

(10) Patent No.: US 8,757,179 B2
(45) Date of Patent: Jun. 24, 2014

(54) DISHWASHER ASSEMBLY HAVING AN AIR CONDUIT

(75) Inventors: Timothy Martin Wetzel, Louisville, KY (US); Joseph Duane Tobbe, Taylorsville, KY (US)

(73) Assignee: General Electric Company, Schenectady, NY (US)

( * ) Notice: Subject to any disclaimer, the term of this patent is extended or adjusted under 35 U.S.C. 154(b) by 1745 days.

(21) Appl. No.: 11/263,222

(22) Filed: Oct. 31, 2005

(65) Prior Publication Data

US 2007/0095369 A1 May 3, 2007

(51) Int. Cl.
*A47L 15/48* (2006.01)

(52) U.S. Cl.
USPC ..... 134/102.3

(58) Field of Classification Search
USPC ..... 134/102.3
See application file for complete search history.

(56) References Cited

U.S. PATENT DOCUMENTS 3,026,628 A * 3/1962 Berger, Sr. et al. ..... 34/231
3,658,075 A 4/1972 Jacobs
3,789,860 A 2/1974 Katterheinrich et al.
4,247,158 A 1/1981 Quayle
4,657,036 A 4/1987 Yake
5,355,900 A * 10/1994 Sakata ..... 134/95.2
5,875,809 A 3/1999 Barrom
6,349,731 B1 2/2002 Schaaf et al.
2006/0236556 A1 * 10/2006 Ferguson et al. ..... 34/73

FOREIGN PATENT DOCUMENTS

FR 2491322 * 9/1982 ..... A47L 15/48
JP 409168499 A * 6/1997 ..... A47L 15/42
KR 1020050054698 * 6/2005 ..... A47L 15/00

* cited by examiner

*Primary Examiner* — Michael Barr
*Assistant Examiner* — Jason Riggleman
(74) *Attorney, Agent, or Firm* — Global Patent Operation; Douglas D. Zhang

(57) ABSTRACT

A dishwasher includes a cabinet having a wash chamber defined therein, a tub positioned within the wash chamber, a door coupled to the cabinet, and a fan positioned within the cabinet. An air conduit is positioned within the dishwasher and includes a conduit body configured to be mounted onto the door. The conduit body includes an air inlet and an air outlet, the air inlet is configured to be coupled in flow communication with the fan. The air conduit body is configured to channel air from the wash chamber through the conduit to an outside of the dishwasher, isolate the air within the conduit body from contacting the door, and provide a receptacle for condensed water other than a wash chamber tub.

20 Claims, 4 Drawing Sheets

DISHWASHER ASSEMBLY HAVING AN AIR CONDUIT

BACKGROUND OF THE INVENTION

This invention relates generally to dishwashers, and more particularly, to methods and apparatus for exhausting air outside of washing units.

Known washing units, such as dishwashers, have a cabinet housing a wash chamber wherein dishes, flatware, cups and glasses, etc. are loaded onto roller-equipped racks. Washing fluid is circulated throughout the wash chamber according to a pre-designated wash cycle executable by a control mechanism. At least some known dishwashers also include a dry cycle following the wash cycle. The dry cycle operates a heating element located within the wash chamber and a forced air convection system that circulates hot humid air through dishwasher vents to remove humidity from the wash chamber and dry the items located therein.

However, at least some known air convection systems for dishwashers channel the hot humid air along an inner surface of a dishwasher door and then outside the wash chamber. Condensation occurs upon the hot humid air coming into contact with the cooler inner surface. Such condensation is undesirable in appearance, and the condensation also may drip onto the floor immediately in front of the dishwasher, particularly upon opening of the dishwasher door.

BRIEF DESCRIPTION OF THE INVENTION

In one aspect, an air conduit is provided for a dishwasher including a cabinet having a wash chamber defined therein. A tub is positioned within the wash chamber and a door is coupled to the cabinet. A fan is also positioned within the cabinet. The conduit includes a conduit body configured to be mounted onto the door. The conduit body includes an air inlet and an air outlet, the air inlet is configured to be coupled in flow communication with the fan. The air conduit body is configured to channel air from the wash chamber through the conduit to an outside of the dishwasher, isolate the air within the conduit body from contacting the door, and provide a receptacle for condensed water other than a wash chamber tub.

In another aspect, a dishwasher is provided that includes a cabinet defining a wash chamber therein and a tub positioned with the wash chamber, a door coupled to the cabinet and a fan positioned within the cabinet and configured to create an air flow within the wash chamber. An air conduit is positioned within the cabinet and is coupled in flow communication with the fan. The air conduit includes an air inlet, a condensation opening, a trough, and an air outlet positioned within the trough. The conduit is configured to channel air from the wash chamber to the outside of the dishwasher and isolate the air within the conduit from contacting the door.

In another aspect, a method is provided for assembling a dishwasher. The method includes providing a cabinet having a wash chamber defined therein and a tub positioned within the wash chamber, coupling a door to the cabinet, and positioning a fan within the cabinet. The fan is configured to create an air flow within the wash chamber. The method further includes positioning an air conduit within the cabinet and coupling the conduit in flow communication with the wash chamber. The air conduit is configured to channel air from the wash chamber, past a condensation opening, into a trough, and through an outlet opening to an outside of the dishwasher.

DETAILED DESCRIPTION OF THE INVENTION

Figure 1:
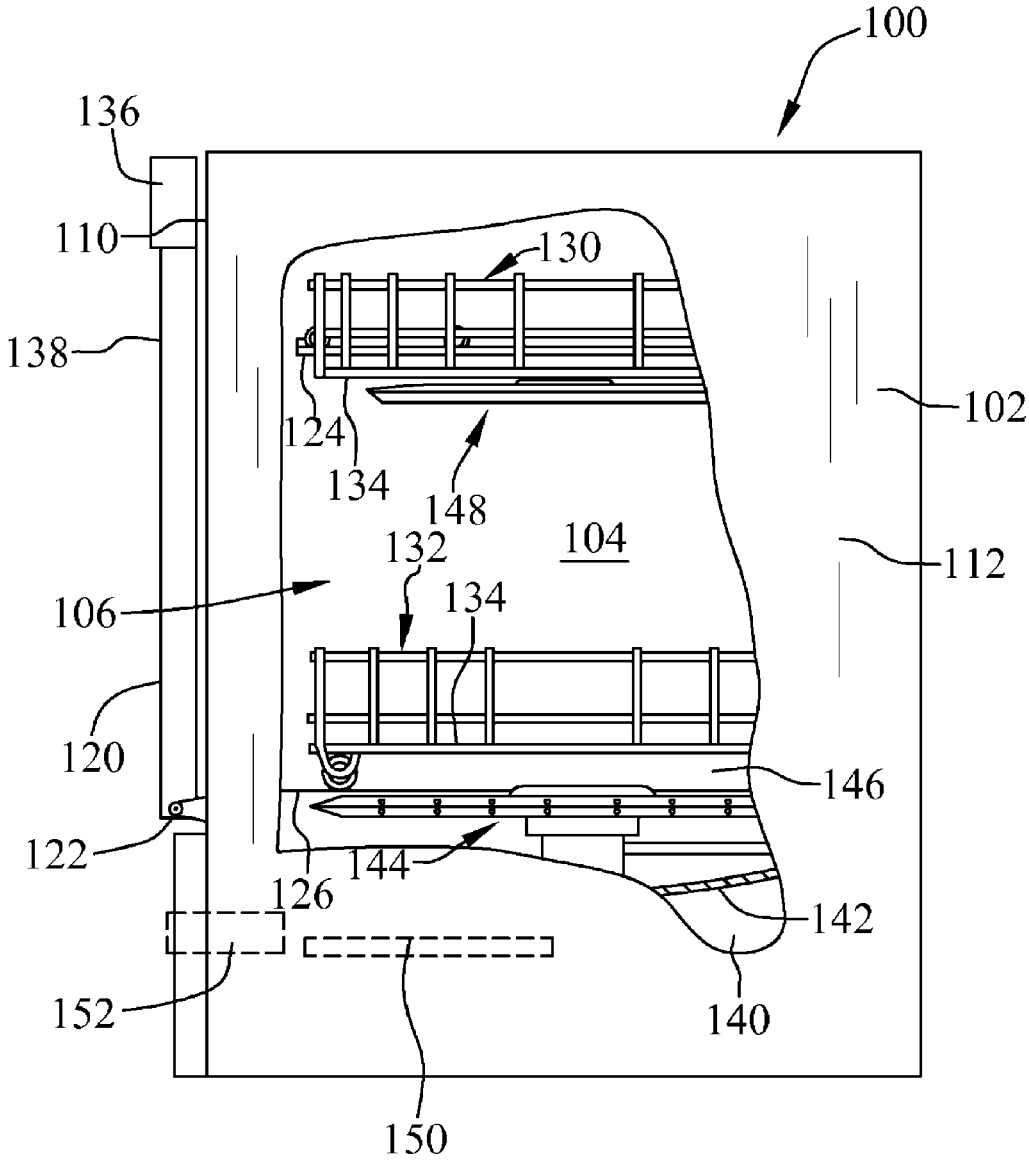
FIG. 1 is a side elevational view of an exemplary dishwasher system.

FIG. 1 is a side elevational view of an exemplary dishwasher system 100 partially broken away. It is contemplated, however, that the methods and apparatus herein described may be practiced in other types of dishwashers and dishwasher systems beyond dishwasher system 100 described and illustrated herein. Accordingly, the following description is for illustrative purposes only, and the methods and apparatus herein described is in no way limited to use in a particular application, or to a particular type of appliance, such as, for example, dishwasher system 100.

Dishwasher 100 includes a tub 104 forming a wash chamber 106 therein. In one embodiment, dishwasher 100 includes a cabinet 102 surrounding tub 104. Cabinet 102 includes a front face 110 and two side walls 112 contacting front face 110. Tub 104 includes a front opening (not shown in FIG. 1) and a door assembly 120 pivotally attached by a hinge 121 at a bottom 122 for movement between a normally closed vertical position (shown in FIG. 1) wherein wash chamber 106 is sealed shut for washing operation, and a horizontal open position (not shown) for loading and unloading of dishwasher contents. An upper guide rail 124 and a lower guide rail 126 are mounted within tub 104 and accommodate an upper roller-equipped rack 130 and a lower roller-equipped rack 132. Each of upper and lower racks 130, 132 is fabricated from known materials into lattice structures including a plurality of elongate members 134, and each rack 130, 132 is adapted for movement between an extended loading position (not shown) in which the respective rack (130, 132) is substantially positioned outside wash chamber 106, and a retracted position (shown in FIG. 1) in which the respective rack (130, 132) is located inside wash chamber 106. A silverware basket (not shown) is removably attached to lower rack 132 for placement of silverware, utensils, and the like that are too small to be accommodated by upper and lower racks 130, 132.

A control panel (not shown) is integrated into an escutcheon 136 that is mounted to door assembly 120. In further and/or alternative embodiments, a plurality of control selectors, (e.g., buttons, switches or knobs) or control displays etc. are mounted at a convenient location on an outer face 138 of door assembly 120. The control panel and associated selectors and displays are coupled to known control circuitry (not shown) and control mechanisms (not shown) for operating a fluid circulation assembly (not shown) that circulates water and dishwasher fluid in dishwasher tub 104. The fluid circulation assembly is located in a machinery compartment 140 located below a bottom sump portion 142 of tub 104. The construction and operation of the fluid circulation assembly is well within the purview of those in the art without detailed explanation, and further discussion of the fluid circulation assembly is therefore omitted.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 and is located in close proximity to upper rack 130 and at a sufficient height above lower rack 132 to accommodate a larger item, such as a dish or platter (not shown), that can be placed in lower rack 132 and washed in dishwasher 100. In another embodiment, an upper spray arm assembly (not shown) is located above upper rack 130 at a sufficient height to accommodate a taller item that can be placed in upper rack 130, such as a glass (not shown) of a selected height.

Lower and mid-level spray-arm assemblies 144 and 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 provides a rotational force by virtue of washing fluid flowing through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated and door assembly 120 is properly closed to seal wash chamber 106 for operation.

Dishwasher 100 also includes an electrical heater 150 positioned within wash chamber 106 and below lower spray-arm assembly 144, and a lower tub member 152 mounted at least partially within cabinet 102. Heater 150 is energized to heat the air within wash chamber 106 in a dry cycle of dishwasher 100 (described in detail hereinafter). It is appreciated, however, that heater 150 may be located at other positions within cabinet 102 to heat the air in alternative embodiments. In a further embodiment, heater 150 is mounted outside of dishwasher 100. Lower tub member 152 is positioned below door assembly 120 and collects water condensed in dishwasher 100. This water is then recirculated in wash chamber 106.

Figure 2:
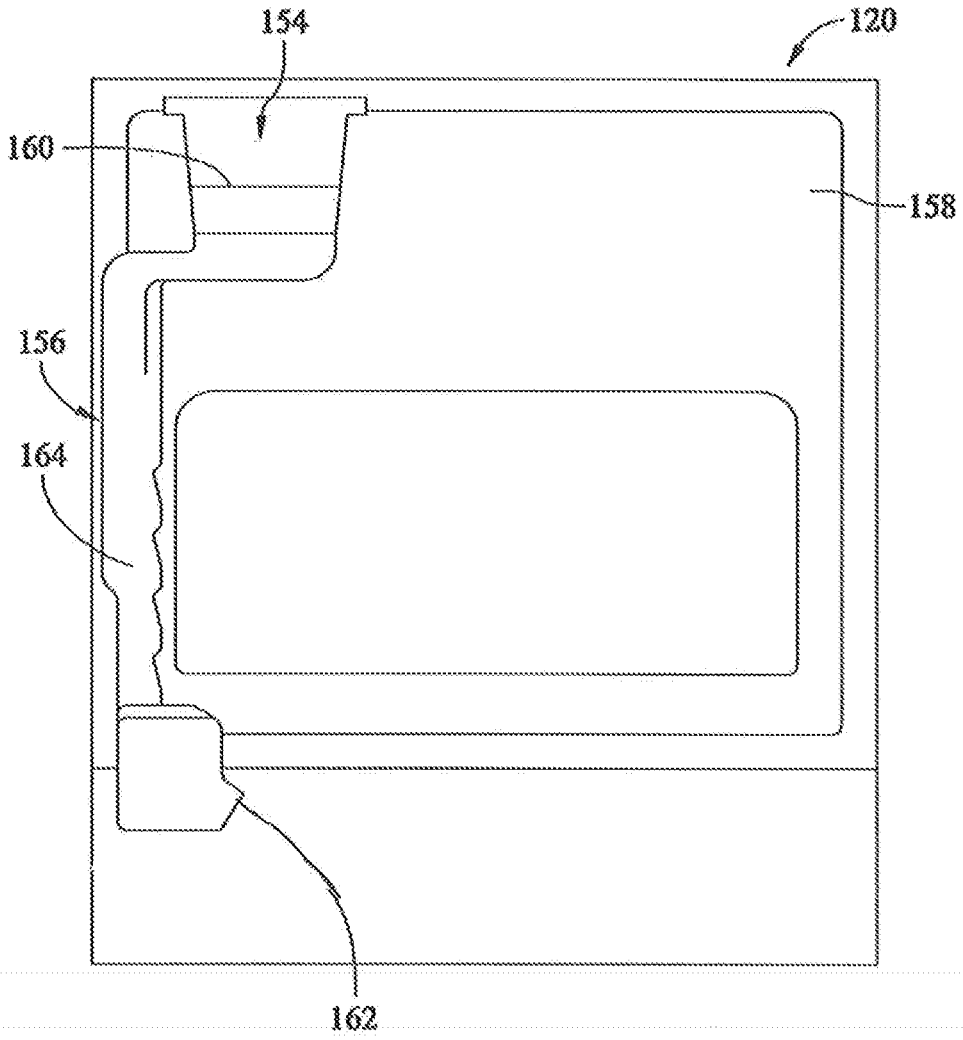
FIG. 2 is a back elevational view of an exemplary door assembly applicable to the dishwasher shown in FIG. 1.

FIG. 2 is a back elevational view of door assembly 120 with a fan 154 and an air conduit 156 mounted thereon. Fan 154 is mounted at an inner surface 158 of door assembly 120, and is positioned within wash chamber 106 (shown in FIG. 1) when door assembly 120 closes wash chamber 106. As such, fan 154 is energized to create an air flow within wash chamber 106 in the dry cycle (described in detail hereinafter). It is appreciated, however, that fan 154 is not limited to be mounted to inner surface 158, but may also be mounted at other positions in alternative embodiments.

Air conduit 156 is mounted on inner surface 158 of door assembly 120, and is substantially vertically positioned within wash chamber 106 (shown in FIG. 1). Air conduit 156 includes an air inlet 160 coupled in flow communication with fan 154, an air outlet 162 substantially extending downward through wash chamber 106, and a conduit body 164 extending between inlet 160 and outlet 162. As such, air conduit 156 channels the air from fan 154 downward and to the outside of dishwasher 100 (shown in FIG. 1).

Figure 3:
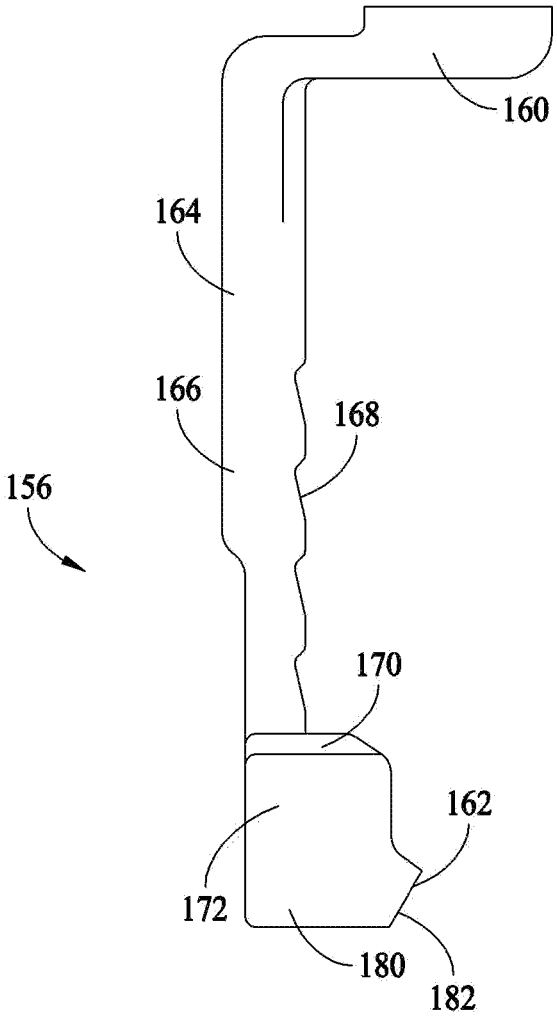
FIG. 3 is a back elevational view of an exemplary air conduit applicable to the dishwasher shown in FIG. 1.
Figure 4:
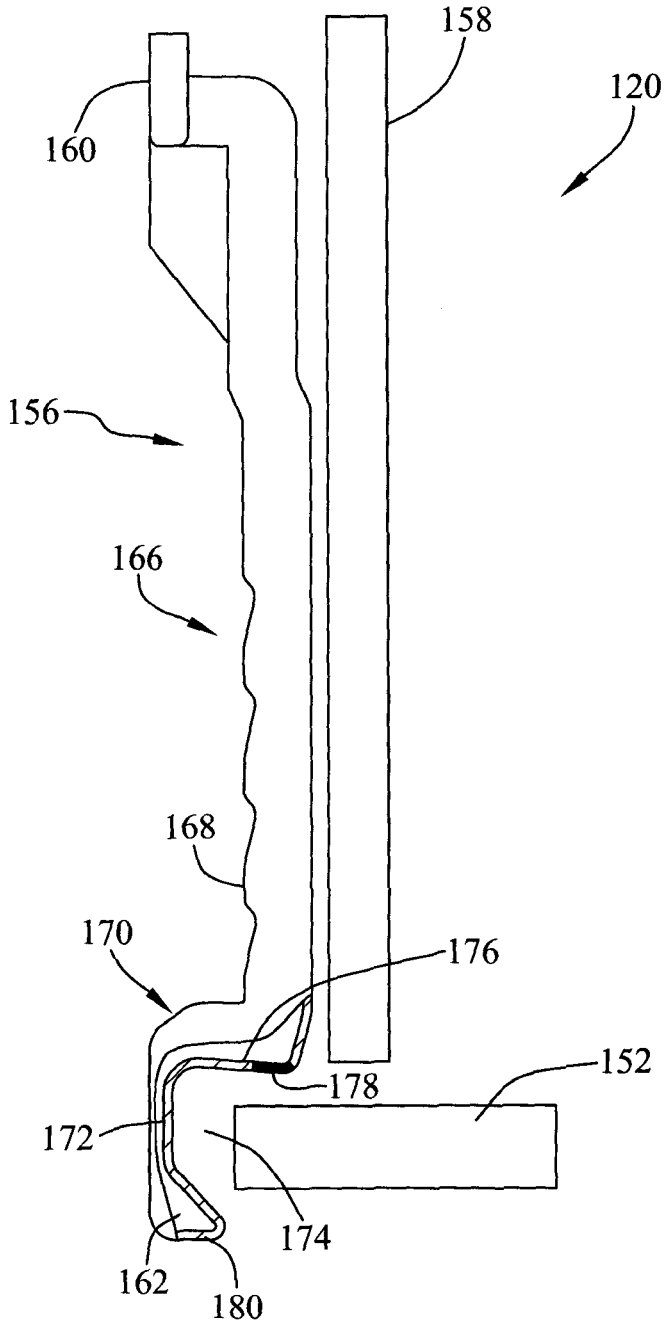
FIG. 4 is a partial sectional view of the air conduit mounted on the door assembly shown in FIG. 2.

FIG. 3 is a back elevational view of air conduit 156 for dishwasher 100 shown in FIG. 1, and FIG. 4 is a side elevational view of air conduit 156 mounted on door assembly 120. Conduit body 164 extends downward beyond inner surface 158, and includes a serrated, or stepped, portion 166 having a serrated inner surface 168, an angled portion 170 positioned below serrated portion 166, and a tail portion 172 extending downward from angled portion 170.

Angled portion 170 extends substantially perpendicularly from serrated portion 166, and defines a receiving space 174 that receives at least a portion of lower tub member 152. Angled portion 170 also includes a slant wall 176 extending inward and slightly upward from a bottom of serrated portion 166, and an opening 178 defined through slant wall 176 and substantially located at the lowest portion of slant wall 176. Opening 178 is located below serrated portion 166 and above receiving space 174, such that opening 178 channels water within conduit body 164 to lower tub member 152 and then to wash chamber 106.

In the exemplary embodiment, tail portion 172 is narrowed compared with angled portion 170, and extends downward between door assembly 120 and front of tub 104 to a trough 180. Trough 180 is positioned downstream of opening 178 and slant wall 176. It is configured to contain an amount of water that passes opening 178 without exiting to a portion of lower tub member 152, such as, for example, a portion of lower tub member 152 extending below door assembly 120. In one embodiment, trough 180 is positioned below the portion of lower tub member 152 extending below door assembly 120. Trough 180 includes an upper extending wall 182 and opening 162 which extends through wall 182. Opening 162 is positioned a sufficient distance up wall 182 such that trough 180 can contain an amount of water without it leaking through opening 162.

In one embodiment, wall 182 slants outward such that opening 162, which extends substantially perpendicularly through wall 182, is directed to a floor on which dishwasher 100 rests. Air exits opening 162 into an area outside of dishwasher 100 since at least a portion of wall 182 extends outside of dishwasher 100. In this manner, exhausted air which exits through opening 162, does not contact door assembly 120 and therefore no condensation occurs on door assembly 120.

In one embodiment, the angle of wall 182 is any angle such that wall 182 is directed away from dishwasher 100. In a more particular embodiment, the angle of wall 182 is between about 15 to about 75 degrees. In another embodiment, the angle of wall 182 is about 30 to about 60 degrees.

In an alternative embodiment, trough 180 is removable from conduit 156 so that it can be emptied if it fills with water. In another embodiment, trough 180 is integral with conduit 156 and is designed so that the amount of water it captures will be less than the amount of water it can hold.

In one embodiment, tail portion 172 also extends transversely and toward one of side walls 112 (shown in FIG. 1), such that air outlet 162 faces the corresponding side wall 112. It is contemplated, however, that the shape of the tail portion and the location of the air outlet may be varied in alternative embodiments.

During a dry cycle, which generally follows a wash cycle, electrical heater 150 (shown in FIG. 1) is energized to heat the air within wash chamber 106 (shown in FIG. 1), and fan 154 (shown in FIG. 2) is also energized to create an air flow within wash chamber 106. As such, heated air flows around washed items, such as for example, washed dishes or other utensils (not shown) positioned within wash chamber 106, removes water from wash chamber 106, and dries the washed items. As the heated air becomes humid it is drawn into air inlet 160 of air conduit 156 by fan 154 (shown in FIG. 2). In another embodiment, fan 154 runs without the addition of heat from a heater and fan 154 draws humid air into air inlet 160 of air conduit 156.

The humid air is isolated from contacting door assembly 120 when being channeled through air conduit 156. Water condensation occurs when the humid air contacts the inner surface of air conduit 156 which has a relatively lower temperature. Specifically, stepped inner surface 168 enlarges the area contacting the humid air, and facilitates water condensation within air conduit 156 and thus reduction of moisture from the air. Condensed water flows downward along conduit body 164, and is channeled through opening 178 defined on angled portion 170 to lower tub member 152 which collects the condensed water.

The dried air is then channeled to the outside of air conduit 156 through air outlet 162 defined on tail portion 172. In the exemplary embodiment, air outlet 162 faces one of side walls 112 (shown in FIG. 1), such that the air may be channeled to the outside of dishwasher 100 (shown in FIG. 1). In one embodiment, the air is exhausted to a space below tub 104. In one embodiment, air vents are hidden on front surface 110 (shown in FIG. 1) to provide an integrated appearance of dishwasher 100.

Air conduit 156 isolates humid air from contacting inner surface 158 (shown in FIG. 2) of door assembly 120, such that water condensation on door assembly 120 is reduced. Trough 152 is positioned below door assembly 120 and opening 178 of air conduit 156. Condensed water within air conduit 156 is channeled to wash chamber 106 of dishwasher 100 through opening 178. Therefore, water dripping onto the floor in front of dishwasher 100 is reduced. In addition, moisture in the air is reduced before being channeled to the outside, such that condensation on air outlet 162 is reduced, which facilitates providing a dry appearance of dishwasher 100.

While the invention has been described in terms of various specific embodiments, those skilled in the art will recognize that the invention can be practiced with modification within the spirit and scope of the claims.

What is claimed is:

1. An air conduit for a dishwasher including a cabinet having a wash chamber defined therein, a tub positioned within the wash chamber, a door coupled to the cabinet, and a fan positioned within the cabinet, said air conduit comprising:

a passageway having an air inlet and an air outlet, said air inlet being configured to be coupled in flow communication with the fan, said air outlet being configured to direct air to an ambient environment outside of the tub; wherein the passageway comprises:

a stepped portion extending from the air inlet;

an angled portion positioned below the stepped portion and extending substantially perpendicularly from the stepped portion;

the angled portion including a slant wall having a condensation opening, the condensation opening being configured to direct condensed water from said air conduit to said tub, said condensation opening positioned downstream of said air inlet and upstream of said air outlet;

the angled portion defining a receiving space that receives at least a portion of the tub; and a trough coupled to the passageway and positioned downstream of said condensation opening and said receiving space, the trough including an upper extended wall, the air outlet extending substantially perpendicularly through the upper extended wall, wherein the air outlet is positioned a distance up the upper extended wall to prevent condensed water in the trough from exiting the trough.

2. An air conduit in accordance with claim 1 wherein the stepped portion comprises a stepped inner surface configured to reduce moisture from the air channeled through said conduit.

3. An air conduit in accordance with claim 1 wherein said trough extends below the door and includes said air outlet to provide flow communication with the ambient environment outside of the tub.

4. An air conduit in accordance with claim 1 wherein said trough is integral with said conduit.

5. An air conduit in accordance with claim 1 wherein said upper extended wall slants outward so that the air outlet is directed towards a floor on which the dishwasher sits and the air outlet is configured to channel air downward and away from the dishwasher.

6. An air conduit in accordance with claim 1 wherein said trough is further configured to be removable such that the trough can be emptied if the trough fills with water.

7. An air conduit in accordance with claim 5 wherein said air outlet is further configured to channel air at about 30 to about 60 degrees downward.

8. A dishwasher comprising:

a cabinet including a wash chamber therein and a tub positioned within said wash chamber;

a door coupled to said cabinet;

a fan positioned within said cabinet and configured to create an air flow within said wash chamber; and an air conduit positioned within said cabinet and coupled in flow communication with said fan, said air conduit comprising an air inlet and an air outlet, a stepped passageway, an angled portion opposite the air inlet, a condensation opening disposed within the angled portion, the angled portion defining a receiving space to receive a portion of the tub, a trough, the trough having an upper extending wall in which the air outlet is disposed, said air conduit configured to channel air from the wash chamber to an ambient environment outside of said dishwasher, said condensation opening positioned downstream of said air inlet and upstream of said air outlet, said condensation opening configured to direct condensed water from said air conduit to said tub, wherein said trough is positioned downstream of said condensation opening, the air outlet being disposed a distance up the upper extending wall to prevent any condensed water in the trough from exiting the trough.

9. The air conduit of claim 1 wherein the passageway comprises a tail portion between the angled portion and the trough, the tail portion having a narrower cross-section than the angled portion, the tail portion extending downwardly from the angled portion in front of the tub to the trough.

10. The air conduit of claim 1 wherein the trough is removable from the passageway.

11. A dishwasher in accordance with claim 8 wherein said trough is further configured to be removable such that the trough can be emptied if the trough fills with water.

12. A dishwasher in accordance with claim 8 wherein said trough is configured to receive water that passes through said conduit beyond said condensation opening.

13. A dishwasher in accordance with claim 8 wherein said upper extending wall including said air outlet slants outward so that the air outlet is directed towards a floor on which the dishwasher rests.

14. A dishwasher in accordance with claim 8 wherein said air outlet is further configured to channel air downward and away from said dishwasher.

15. A dishwasher in accordance with claim 8 wherein said stepped passageway comprises a serrated inner surface configured to reduce moisture from the air channeled through said conduit.

16. A dishwasher in accordance with claim 8 wherein said trough extends below said door and includes said air outlet to provide flow communication with the ambient environment outside of the tub.

17. A dishwasher in accordance with claim 8 wherein said cabinet further comprises a front face and two side walls, said door mounted to said front face, said side walls contacting said front face.

18. A dishwasher in accordance with claim 8 further comprising an electrical heater positioned within said cabinet and configured to heat the air within said wash chamber.

19. An air conduit in accordance with claim 14 wherein said air outlet is further configured to channel air at about 30 to about 60 degrees downward.

20. The dishwasher of claim 8, wherein the trough is removable from the angled portion of the air conduit.

* * * * *